US007247607B2

(12) United States Patent
Choi

(10) Patent No.: US 7,247,607 B2
(45) Date of Patent: Jul. 24, 2007

(54) ACTIVE SOLUBLE CLEANING COMPOSITE OF NATURAL STATE USING SOYBEAN FATTY ACIDS AND THE MAKING METHOD THEREOF

(75) Inventor: Kwang-Hwa Choi, Seoul (KR)

(73) Assignee: Green & Clean, Inc., Seoul (KR)

( * ) Notice: Subject to any disclaimer, the term of this patent is extended or adjusted under 35 U.S.C. 154(b) by 622 days.

(21) Appl. No.: 10/494,190

(22) PCT Filed: Oct. 25, 2002

(86) PCT No.: PCT/KR02/01990

§ 371 (c)(1),
(2), (4) Date: Apr. 30, 2004

(87) PCT Pub. No.: WO03/040281

PCT Pub. Date: May 15, 2003

(65) Prior Publication Data

US 2004/0266646 A1 Dec. 30, 2004

(30) Foreign Application Priority Data

Nov. 8, 2001 (WO) ..... PCT/KR01/01899

(51) Int. Cl.
*C11D 1/70* (2006.01)
*C11D 3/32* (2006.01)
*C11D 3/382* (2006.01)

(52) U.S. Cl. ..... 510/437; 510/119; 510/130; 510/153; 510/235; 510/356; 510/421; 510/422; 510/480

(58) Field of Classification Search ..... 510/119, 510/130, 153, 235, 356, 421, 422, 437, 480
See application file for complete search history.

(56) References Cited

U.S. PATENT DOCUMENTS 4,297,251 A 10/1981 Bernardion et al.
5,415,787 A 5/1995 Vlasblom et al.
5,641,480 A * 6/1997 Vermeer ..... 424/70.24

FOREIGN PATENT DOCUMENTS

| | | |
|---|---|---|
| JP | 63-96161 | 4/1988 |
| JP | 01-96112 | 4/1989 |
| JP | 04-173900 | 6/1992 |
| JP | 05-927 | 1/1993 |
| JP | 08-12995 | 1/1996 |
| KR | 1994-0004043 | 3/1994 |

* cited by examiner

*Primary Examiner*—Charles Boyer
(74) *Attorney, Agent, or Firm*—Jordan and Hamburg LLP

(57) ABSTRACT

Disclosed is an active and water-soluble natural detergent composite using soybean fatty acid and lecithin, and a method of producing the same. The method comprises agitating a mixture consisting of a natural vegetable fatty acid, lecithin, alkanolamide, and an organic solvent such as higher alcohol or polyhydric alcohol, saponifying the mixture to form microscopic detergent particles moving according to Brownian movement, and controlling the resulting detergent in terms of moisture and pH to allow the resulting detergent to be in a neutral or alkaline state. The detergent composite comprises 14 to 22 parts by weight of soybean fatty acid, 2 to 4 parts by weight of lecithin, 6 to 14 parts by weight of alkanolamide, 15 parts by weight of isooctylphenoxy polyoxyethoxy ethanol, 42 parts by weight of distilled water, 10 parts by weight of p-tert-oxyphenoxy polyethoxy ethanol, and 3 parts by weight of ethylene diamine tetracetic acid.

2 Claims, No Drawings

ACTIVE SOLUBLE CLEANING COMPOSITE OF NATURAL STATE USING SOYBEAN FATTY ACIDS AND THE MAKING METHOD THEREOF

TECHNICAL FIELD

The present invention pertains to an active and water-soluble natural detergent composite using lecithin and soybean fatty acid which is wholly vegetable, and a method of producing the same.

BACKGROUND ART

Mostly consisting of polypropylene benzene sulfonate-type hard compounds of propylene tetramer, conventional synthetic detergents cause environmental pollution and negatively affect humans, thus increasingly being restricted in their use.

Although a conventional linear benzene sulfonate-type soft synthetic detergent is suggested instead of the above hard-type synthetic detergent, the soft synthetic detergent has a drawback in that it emits harmful pollutants in water even though it has excellent degradability in water. Additionally, conventional sulphate and sulfonate detergents have disadvantages of requiring additives which emit submicron calcium carbonate, nitrilo triacetic acid, hexamethylene diamine tetracetic acid, and diethylene triamine pentacetic acid in water. Accordingly, there remains a need to develop an environmentally-friendly natural detergent replacing the above conventional detergents.

Furthermore, the conventional synthetic detergent generally has an amphiphilic molecular structure including a lipophilic molecular structure, mostly consisting of hydrocarbon-based fat molecules, and a hydrophilic molecular structure mostly consisting of sulphate, so the molecular size of the conventional synthetic detergent is bulky, due to characteristics of the above amphiphilic molecular structure. Therefore, the conventional synthetic detergent or its micelle does not move in water according to Brownian movement, that is to say, molecules of the conventional synthetic detergent or its micelle do not actively move for themselves without any assistance from external physical forces.

Meanwhile, a washing process using conventional synthetic detergent is conducted while being based on a mechanism that lipophilic molecules of the synthetic detergent stick to contaminants or are penetrated into the contaminants, and then detached in conjunction with the contaminants from a subject which is to be washed.

Accordingly, the conventional detergent is disadvantageous in that it is necessary to form foams, acting as a main factor of water pollution, in abundance, and to frequently contact the detergent molecules with the contaminants by physical action, for example, agitating, rubbing, and beating, so that the synthetic detergent molecules desirably penetrate contaminants attached to the subject. Furthermore, it is also necessary to agitate, rub, and beat the subject so as to detach the detergent molecules attached to the contaminants, and so as to smoothly disperse and diffuse the detergent molecules and contaminants detached from the subjective in water.

Other disadvantages of the conventional detergent are that it is difficult to satisfy a desired washability without physical actions such as agitating, rubbing, and beating provided by washers or humans, and water contaminating foam is formed and various compounds constituting such conventional detergents negatively affect environments and human bodies.

DISCLOSURE OF THE INVENTION

Accordingly, the present invention has been made keeping in mind the above problems occurring in the prior art, and an object of the present invention is to provide a detergent, which easily removes contaminants attached to a surface of a person's skin and various organic and inorganic materials, and has multiple functions of penetration, moisturization, emulsification, dispersion, washing, and decomposition, and a method of producing the same.

Based on the present invention, the above object can be accomplished by providing an active and water-soluble natural detergent composite produced by a method comprising speedily agitating a mixture consisting of natural vegetable fatty acid such as natural soybean fatty acid and rice bran fatty acid, lecithin, alkanolamide, and an organic solvent such as higher alcohol and polyhydric alcohol, and saponifying the mixture while adding a predetermined activating component and additives to the mixture to form microscopic detergent particles moving according to Brownian movement. At this time, the resulting detergent is controlled in terms of pH to be in a neutral or alkaline state, as desired.

Generally, if lecithin is mixed with a vegetable fat, the molecular structure constituting the vegetable fat is partially destructed, thus being converted into a water-soluble molecular structure. For example, when the vegetable fat is mixed with an eggyolk, the vegetable fat is partially destructed in terms of its molecular structure to be converted into a water-soluble compound such as mayonnaise. In the case of using the vegetable fatty acid instead of the vegetable fat, the molecular structure of the vegetable fatty acid is easily and partially destructed. The present invention is based on this theoretical background.

According to the present invention, the detergent has a lipophilic hydrocarbon-based molecular structure, and the molecules or micelles of its molecule actively move according to Brownian movement without any physical action, thus being rapidly diffused, thus they irregularly and freely move in water. Hence, the detergent of the present invention comes into contact with the contaminants, penetrates them and collides with the contaminants according to Brownian movement without physical action, and then detaches the contaminants from the subject by the kinetic energy and collision energy of the detergent molecules.

BEST MODE FOR CARRYING OUT THE INVENTION

There will be given a more detailed description of an active and water-soluble natural detergent composite using soybean fatty acid and lecithin, and a method of producing the same, below.

The water-soluble natural detergent composite of the present invention comprises 14 to 22 parts by weight of soybean fatty acid, 2 to 4 parts by weight of lecithin, 6 to 14 parts by weight of alkanolamide, 15 parts by weight of isooctylphenoxy polyoxyethoxy ethanol, 42 parts by weight of distilled water, 10 parts by weight of p-tert-oxyphenoxy polyethoxy ethanol, and 3 parts by weight of ethylene diamine tetracetic acid.

For example, when a content of soybean fatty acid is more than 22 parts by weight, viscosity of the water-soluble detergent of the present invention is excessively increased, causing difficulty in spraying the detergent to the contaminants. On the other hand, when the content is less than 14 parts by weight, biodegradability of the detergent of the present invention is poor. Likewise, when alkanolamide is added to the detergent of the present invention in a content more than 14 parts by weight, the viscosity of the water-soluble detergent of the present invention is increased, causing difficulty in spraying the detergent to the contaminants, but when alkanolamide is added in the content less than 6 parts by weight, biodegradability of the detergent of the present invention is poor.

According to the present invention, it is preferable that soybean fatty acid be used as a vegetable higher fatty acid extracted from natural plants. Alternatively, other vegetable fatty acids such as rice bran fatty acid may be used instead of soybean fatty acid.

A better understanding of the present invention may be obtained in light of the following example which is set forth to illustrate, but is not to be construed to limit the present invention.

An active and water-soluble natural detergent composite according to the present invention was produced by following a method comprising the three steps: the first step of speedily agitating a mixture including 14 to 22 parts by weight of soybean fatty acid, 2 to 4 parts by weight of lecithin, 6 to 14 parts by weight of alkanolamide, 15 parts by weight of isooctylphenoxy polyoxyethoxy ethanol, 10 parts by weight of p-tert-oxyphenoxy polyethoxy ethanol, 3 parts by weight of ethylene diamine tetracetic acid acting as an auxiliary additive, and 42 parts by weight of distilled water; the second step of saponifying the mixture to form microscopic detergent molecules moving according to Brownian movement; and the third step of controlling the resulting detergent in terms of moisture and pH to allow the resulting detergent to be in a neutral or alkaline state, as desired.

Molecules of the resulting detergent or micelles of its molecule actively moved according to Brownian movement for themselves without any physical action, thus being rapidly diffused, thus they irregularly and freely moved in water. Therefore, the detergent of,the present invention came into contact with the contaminants, penetrated them and collided with the contaminants according to Brownian movement without physical action, and then detached the contaminants from the subject by the kinetic energy and collision energy of the detergent molecules. Furthermore, the detergent of the present invention maintained its improved washability and biodegradability in hard water, soft water, and brine, and was environmentally friend because it did not contain hazardous compounds such as sulphate, phosphate, nitrate, and nitrilo triacetic acid.

A test for biodegradability of the active and water-soluble natural detergent composite according to the present invention was conducted by Korea Merchandise Testing and Research Institute (Test method: KS M2714-92), and the results are described in Table 1.

TABLE 1

| Sample | Natural detergent composite (according to the present invention) |
|---|---|
| Biodegradability | 99% |
| Test method | KS M 2714-92 |

From the results of Table 1, it can be seen that the biodegradability of the natural detergent composite of the present invention is 99%. This value cannot be obtained from the conventional synthetic detergent.

INDUSTRIAL APPLICABILITY

As described above, an active and water-soluble natural detergent composite using soybean fatty acid and lecithin according to the present invention is advantageous in that it is not necessary to form foam in order to smoothly contact detergent molecules to contaminants, or to use various hazardous compounds as additives, unlike a conventional synthetic detergent, thus being environmentally friend and harmless to humans.

Other advantages of the water-soluble natural detergent composite of the present invention are that its washability is caused by the Brownian movement of its molecules to reduce efforts required to wash and rinse a subject which is to be washed, so washing time, and consumption amount of electricity and water are reduced in the case of applying the detergent of the present invention to a washing machine or dishwasher.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

The invention claimed is:

1. The active soluble cleaning composite of natural state using soybean fatty acids, comprising 14 to 22 parts by weight of soybean fatty acid, 2 to 4 parts by weight of lecithin, 6 to 14 parts by weight of alkanolamide, 15 parts by weight of isooctylphenoxy polyoxyethoxy ethanol, 42 parts by weight of distilled water, 10 parts by weight of p-tert-oxyphenoxy polyethoxy ethanol, and 3 parts by weight of ethylene diamine tetracetic acid.

2. A method of making the active soluble cleaning composite of natural state using soybean fatty acids, comprising:

sufficiently agitating a mixture including 14 to 22 parts by weight of soybean fatty acid, 2 to 4 parts by weight of lecithin, 6 to 14 parts by weight of alkanolamide, 15 parts by weight of isooctylphenoxy polyoxyethoxy ethanol, 42 parts by weight of distilled water, 10 parts by weight of p-tert-oxyphenoxy polyethoxy ethanol, and 3 parts by weight of ethylene diamine tetracetic acid; and saponifying the mixture to form microscopic detergent molecules moving according to Brownian movement.

* * * * *